US006816598B1

(12) United States Patent
Budge

(10) Patent No.: US 6,816,598 B1
(45) Date of Patent: Nov. 9, 2004

(54) MULTIPLE DRIVER, RESONANTLY-COUPLED LOUDSPEAKER

(76) Inventor: Tierry R. Budge, 205 E. 1600 North, Orem, UT (US) 84057

( * ) Notice: Subject to any disclaimer, the term of this patent is extended or adjusted under 35 U.S.C. 154(b) by 0 days.

(21) Appl. No.: 09/405,433

(22) Filed: Sep. 23, 1999

(51) Int. Cl.[7] ..... H04R 1/02
(52) U.S. Cl. ..... 381/89; 381/89
(58) Field of Search ..... 381/89, 332, 97, 381/98; 181/144, 145

(56) References Cited

U.S. PATENT DOCUMENTS

| | | | | |
|---|---|---|---|---|
| 2,993,091 A | | 7/1961 | Guss | |
| 3,918,551 A | | 11/1975 | Rizo-Patron | |
| 4,064,966 A | | 12/1977 | Burton | |
| 4,176,249 A | | 11/1979 | Inanaga et al. | |
| 4,466,505 A | | 8/1984 | Ritter | |
| 4,472,605 A | | 9/1984 | Klein | |
| 4,733,749 A | | 3/1988 | Newman et al. | |
| 4,783,820 A | * | 11/1988 | Lyngdorf | 381/89 |
| 4,924,963 A | | 5/1990 | Polk | |
| 5,073,945 A | * | 12/1991 | Kageyama | 381/89 |
| 5,377,274 A | * | 12/1994 | Meyer | 381/97 |
| 5,526,456 A | | 6/1996 | Heinz | |
| 5,590,214 A | | 12/1996 | Nakamura | |
| 5,701,358 A | | 12/1997 | Larsen et al. | |
| 5,749,433 A | | 5/1998 | Jackson | |
| 5,815,589 A | | 9/1998 | Wainwright et al. | |
| 5,832,099 A | | 11/1998 | Wiener | |
| 5,844,176 A | | 12/1998 | Clark | |
| 5,850,460 A | | 12/1998 | Tanaka et al. | |
| 5,887,068 A | | 3/1999 | Givogue et al. | |
| 6,434,240 B1 | * | 8/2002 | Kulas | 381/89 |

* cited by examiner

*Primary Examiner*—Minsun Oh Harvey
(74) *Attorney, Agent, or Firm*—John R. Thompson; Stoel Rives LLP

(57) ABSTRACT

The present invention is an improved loudspeaker with greatly reduced impedance and improved response and power handling in the low frequency range. The benefits of the present invention derive from a novel, synchronized, multiple driver design in which the output of a first driver is synchronized with the output of a second driver to produce an acoustically reinforced output. This synchronization is achieved through a phase shift of the input signals to the drivers.

16 Claims, 3 Drawing Sheets

MULTIPLE DRIVER, RESONANTLY-COUPLED LOUDSPEAKER

THE FIELD OF THE INVENTION

The present invention relates to the field of high-quality audio loudspeakers and more particularly to loudspeakers which overcome the drawbacks of backwave interference and cancellation as well as other problems with high-fidelity speakers. The speakers of the present invention utilize multiple drivers in a multipolar configuration which are sealed in an isobaric chamber.

BACKGROUND

Loudspeakers are essentially transducers which convert electrical energy into physical, acoustical energy. The design of typical basic loudspeakers has not changed for decades. Generally, a loudspeaker driver consists of a frame or housing, a cone or other diaphragm attached to a voice coil, a surround and spider suspension and a permanent magnet. Sound is created by moving the diaphragm to create sound waves in the air around the diaphragm. This is accomplished through electromagnetic attraction and repulsion of the voice coil. The outer periphery of the diaphragm is connected to the housing or frame by a flexible surround which allows the diaphragm to move freely and helps somewhat to keep the diaphragm and voice coil in proper alignment. The voice coil is typically a coil of wire which forms an inductor. As electrical current passes through the coil it produces a magnetic field. The voice coil is placed in close proximity to a permanent magnet which provides a permanent magnetic field which react with the variable magnetic field of the coil thereby causing the coil to be repelled or attracted according to the field of the coil and the polarity and magnitude of the coil current. The spider and surround keep the coil in precise alignment with the permanent magnet so that minute changes in current in the coil can accurately produce diaphragm movement and sound.

The physical characteristics of drivers can make them more suitable for reproducing sounds in certain frequency ranges. High frequency sound requires a driver that can react quickly, but which does not need a diaphragm that must displace a substantial distance. Low frequency sound requires a driver that can displace longer distances, but which does not need to react as quickly. Consequently, larger drivers, called woofers, are typically used to reproduce low frequency sound while very small, rigid drivers, called tweeters, are used for high frequency sound. A high-quality loudspeaker will generally have multiple drivers for reproducing sound in a variety of frequency ranges. Many loudspeakers will have at least a woofer, midrange and a tweeter to reproduce the entire audible sound spectrum, however, as the following disclosure will reveal, this can be achieved in other ways.

One problem inherent in typical driver design is the "backwave" created when the diaphragm rebounds from an extended position. This creates a sound wave which emanates from the back of the diaphragm which, if not controlled, may interfere with and even cancel the primary sound wave created by the diaphragm.

One method of dealing with backwave interference is to mount the driver in a sealed enclosure that will absorb the majority of the backwave preventing it from reaching the listener. This is commonly known as an "acoustic suspension" speaker. Another popular method of dealing with backwave emissions is to allow part of the wave to reach the listening area through a vent or port. This is known as a "bass reflex" design. Yet another method involves the use of a passive radiator or "drone driver" which vibrates with the backwave thereby absorbing energy and helping eliminate the backwave. All of these methods help somewhat to eliminate backwave interference, however they do so at the cost of lost energy and performance.

Backwave interference can also be dealt with using a bipolar speaker configuration. The typical bipolar configuration utilizes two identical drivers which are mounted in the front and back of a speaker enclosure. These two drivers are driven in-phase so that identical waves are emitted from the front and back of the enclosure. This eliminates the backwave cancellation problem because the waves are in-phase, but the drivers can suffer from a decreased response and lost energy due to the need to overcome increased pressure in the enclosure.

An additional problem with current speaker technology is caused by misalignment of the voice coil with the permanent magnet due to distortion of the diaphragm or cone. Driver surrounds and spiders must be flexible to provide the necessary response to electrical input, but this makes the driver diaphragm extremely susceptible to unequal air pressure across its surface area. As a diaphragm encounters unequal air pressure due to enclosure discontinuities or air flow patterns, the diaphragm distorts causing the attached voice coil to rotate off its central axis. This causes the precisely balanced magnetic fields of the permanent magnet and the voice coil to misalign thereby causing an inductive variance and increased current draw from the amplifier. This results in decreased power handling, poorer response and inaccurate reproduction of sound.

Pressure problems encountered with in-phase bipolar designs can be overcome by using an out-of-phase configuration. In a typical out-of-phase bipolar configuration, identical drivers are mounted facing in opposite directions connected by an isobaric chamber. However, one driver is wired in reverse polarity to the other so that both driver's diaphragms move in the same direction despite facing in opposite directions. This configuration allows the isobaric chamber to remain at a constant volume and pressure. As one diaphragm moves outward, the other moves inward by an equal amount. While the pressure problems are reduced, interference between the drivers remains a problem.

SUMMARY AND OBJECTS OF THE INVENTION

The present invention is a multiple driver, resonantly-coupled loudspeaker which reduces or eliminates the problems of the prior art and provides greatly increased power handling, extended, more linear, response to low frequencies, increased midrange response and lower intermodulation distortion.

The present invention comprises a plurality of drivers which are arranged and oriented such that the back wave from at least one driver may coincide with the front wave of at least one other driver thereby causing interference between the back wave and the front wave. The synchronization circuit of the present invention effectuates a phase shift in the signal transmitted to some of the driver so that the interference between back wave and front wave results in reinforcement of the overall driver output. The drivers of the present invention may be arranged in a multipolar, isobaric configuration, as in a preferred embodiment, or they may be arranged in another configuration which may benefit from the synchronization and reinforced output of the present invention.

In some embodiments of the present invention, an even number of drivers are mounted in an isobaric enclosure which is sized and oriented to enclose the drivers within a minimal volume. The drivers may be oriented to face into the enclosure or face outward from the enclosure. Drivers used in the present invention are divided into pairs with one driver in each pair being directed toward the exterior of the loudspeaker assembly and one driver being directed into an interior acoustical chamber. A novel secondary crossover network is utilized in the present invention to integrate the drivers in this multipolar, isobaric configuration.

Crossover networks, both passive and active, are known for filtering the input signals to loudspeaker drivers. Low pass, high pass, band pass and band reject filters are used to limit the signal frequencies sent to a given driver. These conventional crossover networks may be used with the present invention, however a novel secondary network is also used between the paired drivers themselves to synchronize the paired driver's movement. Conventional out-of-phase multipolar speakers are wired with direct reverse polarity and no secondary crossover. The secondary paired-driver crossover network of the present invention is believed to adjust the phase relationship between the paired drivers so that the backwave from the external driver coincides with and reinforces the frontwave from the internal driver thereby increasing the amplitude of the combined wave emitted from the internal driver's acoustical chamber. This reinforcement can be measured by measuring the response to square wave signals at the port in the internal driver's acoustical chamber.

Accordingly, it is an object of some embodiments of the present invention to provide a loudspeaker with an increased frequency range.

Another object of some embodiments of the present invention is to provide a loudspeaker with greatly reduced inter-modulation distortion.

A further object of some embodiments of the present invention is to provide a loudspeaker with better power handling An additional object of some embodiments of the present invention is to provide a loudspeaker with quicker response.

A still further object of some embodiments of the present invention is to provide a loudspeaker with a lower resonant frequency.

Another object of some embodiments of the present invention is to provide a loudspeaker which provides a full range of response throughout midrange frequencies without the use of a conventional midrange driver.

Yet another object of some embodiments of the present invention is to provide a loudspeaker with a greater, more linear dynamic range.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

In the following description, preferred embodiments of the present invention are described by referring to functional diagrams, schematic diagrams, functional flow charts, program flow charts and other graphic depictions which help to illustrate either the structure or processing of preferred embodiments used to implement the apparatus, system and method of the present invention. Using the diagrams and other depictions in this manner to present the invention should not be construed as limiting of its scope.

Figure 1:
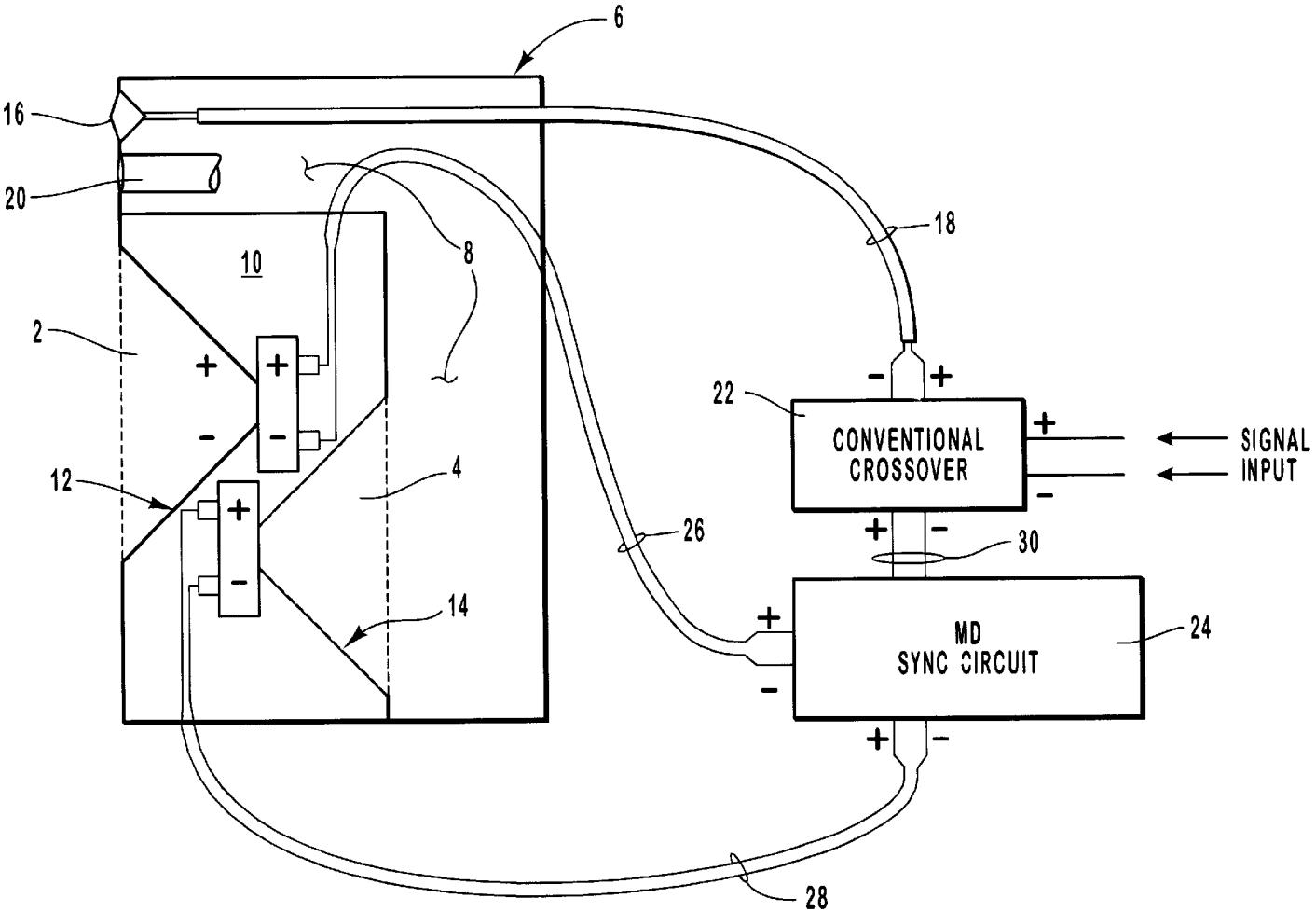
FIG. 1 is a cross-sectional view of a speaker enclosure, drivers, and other components of a first embodiment of the present invention.

The physical layout of a preferred embodiment of the present invention may be understood by reference to FIG. 1 where a pair of similar drivers comprising external driver 2 which emits sound directly to the exterior of loudspeaker enclosure 6 and internal driver 4 which emits sound directly into acoustical chamber 8. Drivers 2 & 4 may be directed in opposite directions, at right angles to each other, in a multipolar configuration or a number of other configurations. Isobaric chamber 10 is a sealed chamber which is substantially airtight. Drivers 2 & 4 are mounted in isobaric chamber 10 such that their diaphragms, external diaphragm 12 and internal diaphragm 14, form a part of the isobaric chamber in such a manner that displacement of either diaphragm, without compensation, will cause a change in the volume of the isobaric chamber 10. In this configuration, movement of external diaphragm 12 will induce a substantially equal movement in internal diaphragm 14. If external diaphragm 12 is displaced outwardly, its movement causes an increase in the volume of isobaric chamber 10 and a corresponding decrease in air pressure within chamber 10. This decreased pressure draws diaphragm 14 into chamber 10 thereby inducing displacement in internal diaphragm 14. In this manner, external diaphragm 12 and internal diaphragm 14 are physically linked by pneumatic action within isobaric chamber 10.

The volume of isobaric chamber 10 should be kept as small as possible for the size of driver being used. A substantially minimal chamber volume creates a crisper pneumatic link between the drivers yielding quicker response times and less energy lost in compressing air in chamber 10. Even with a minimalized volume in isobaric chamber 10 a short distance still remains between driver 2 and driver 4.

In a prior art multipolar, isobaric loudspeaker, both drivers in a pair are fed essentially the same signal except that the signal fed to one driver is inverted. This is typically achieved by switching the polarity of the input signal to one driver. This arrangement makes the drivers, which have opposite orientation, move in the same direction at the same time. However, this prior art arrangement does not account for the lag created by the distance between the drivers.

Sound waves, essentially pressure waves within the isobaric chamber 10, emanating from driver 2 must cross this distance before they encounter their corresponding waves from the same signal sequence emanating from driver 4. This lag causes the drivers to operate non-synchronously and causes interference and cancellation between the drivers' output. The multiple driver synchronization circuit (MD sync) of the present invention is believed to account for this lag between drivers and synchronize the backwave of the external driver 2 with the frontwave of internal driver 4 yielding a reinforced or enhanced wave which emanates into acoustical chamber 8.

Conventional multi-driver loudspeakers have multiple drivers with varying characteristics that make each of the drivers more suitable for reproducing sound in a given frequency spectrum. Because each of these drivers is best suited for a particular frequency range a crossover network is used to filter the input signal into frequency ranges. This can be done with passive filters using inductors, capacitors or other components or it can be achieved with active filters which may employ operational amplifiers or even digital circuitry. The loudspeaker of the present invention may or may not utilize a crossover network, however a crossover network is preferred for embodiments of the present invention which utilize drivers other than the multiple drivers connected to the MD sync circuitry. In the preferred embodiment of the present invention shown in FIG. 1, a tweeter 16 is utilized for reproduction of high frequency sounds. Tweeter 16 is connected directly to the conventional crossover circuitry 22 with typical conductors 18 as known in the industry. While a midrange driver may also be used in specific embodiments of the present invention, it is not necessary due to the increased responsiveness and range extension achieved by the multiple-driver woofers enhanced with the MD sync circuitry.

In the currently preferred embodiment of the present invention, paired drivers 2 & 4 are 10" woofers which provide excellent response from less than 20 Hz up through typical midrange frequencies to above 1KHz. Hence, an advantage of the present invention is the elimination of the need for and cost of a conventional midrange driver.

Figure 2:
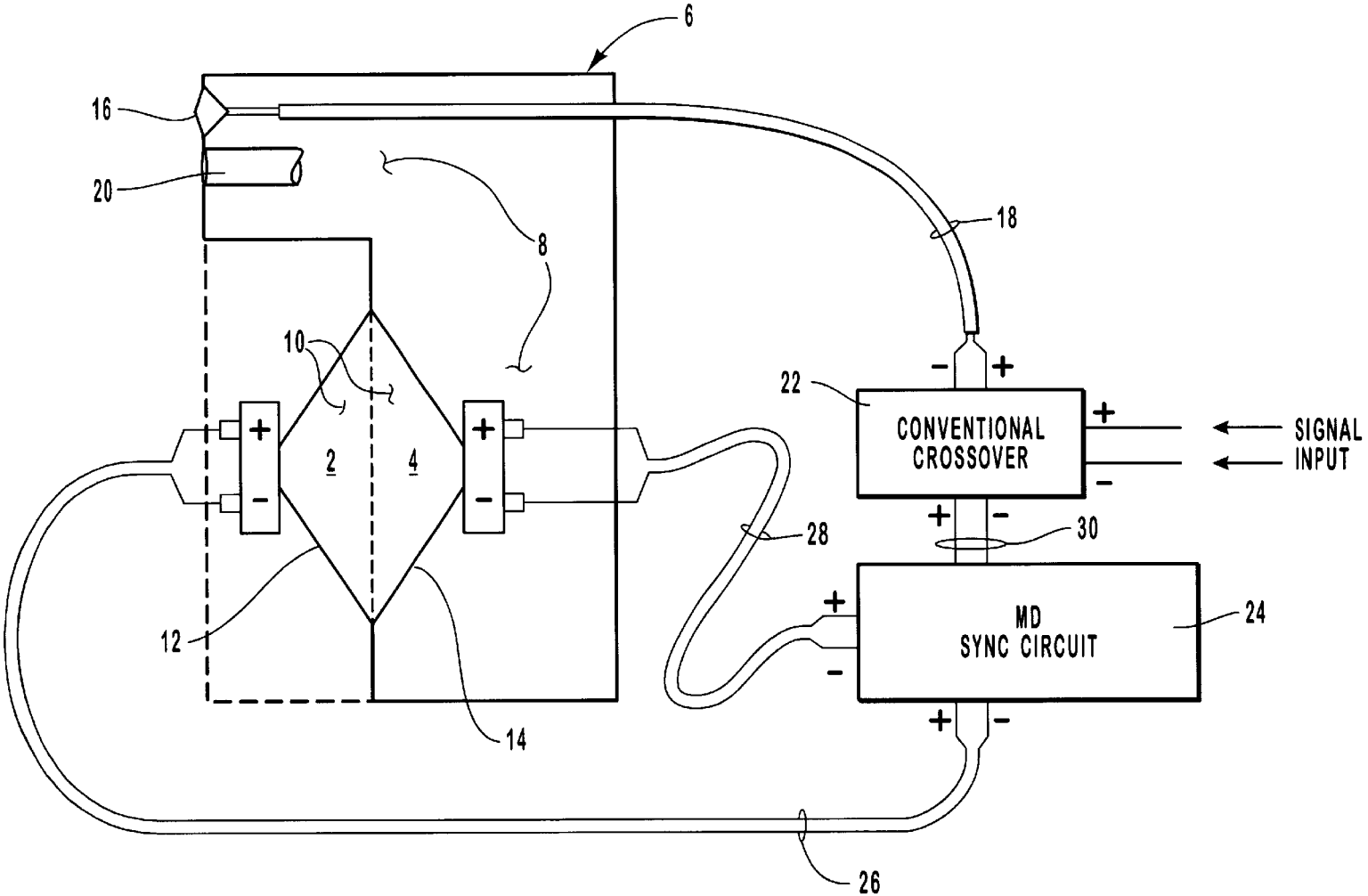
FIG. 2 is a cross-sectional view of a speaker enclosure, drivers, and other components of a second embodiment of the present invention.

Paired drivers 2 & 4 may also be configured in a face-to-face orientation as shown in FIG. 2. This configuration helps to minimize the air volume in the isobaric chamber 10 which is formed by the driver diaphragms. It also puts the drivers in closer proximity thereby reducing the distance the external driver's 2 backwave must travel before coinciding with the frontwave of the internal driver 4. This orientation requires less phase shift correction than those with greater driver spacing, however, the MD sync circuitry still provides a marked performance increase with this orientation.

The paired drivers of the present invention are electrically connected to the novel MD sync circuitry of the present invention with typical conductors 26 & 28 as known in the art. However, instead of wiring one of the drivers in normal polarity and wiring the other driver in reverse polarity, the novel MD sync circuitry of the present invention is used to ameliorate the performance of the multiple driver combination by synchronizing the driver pair.

Figure 3:
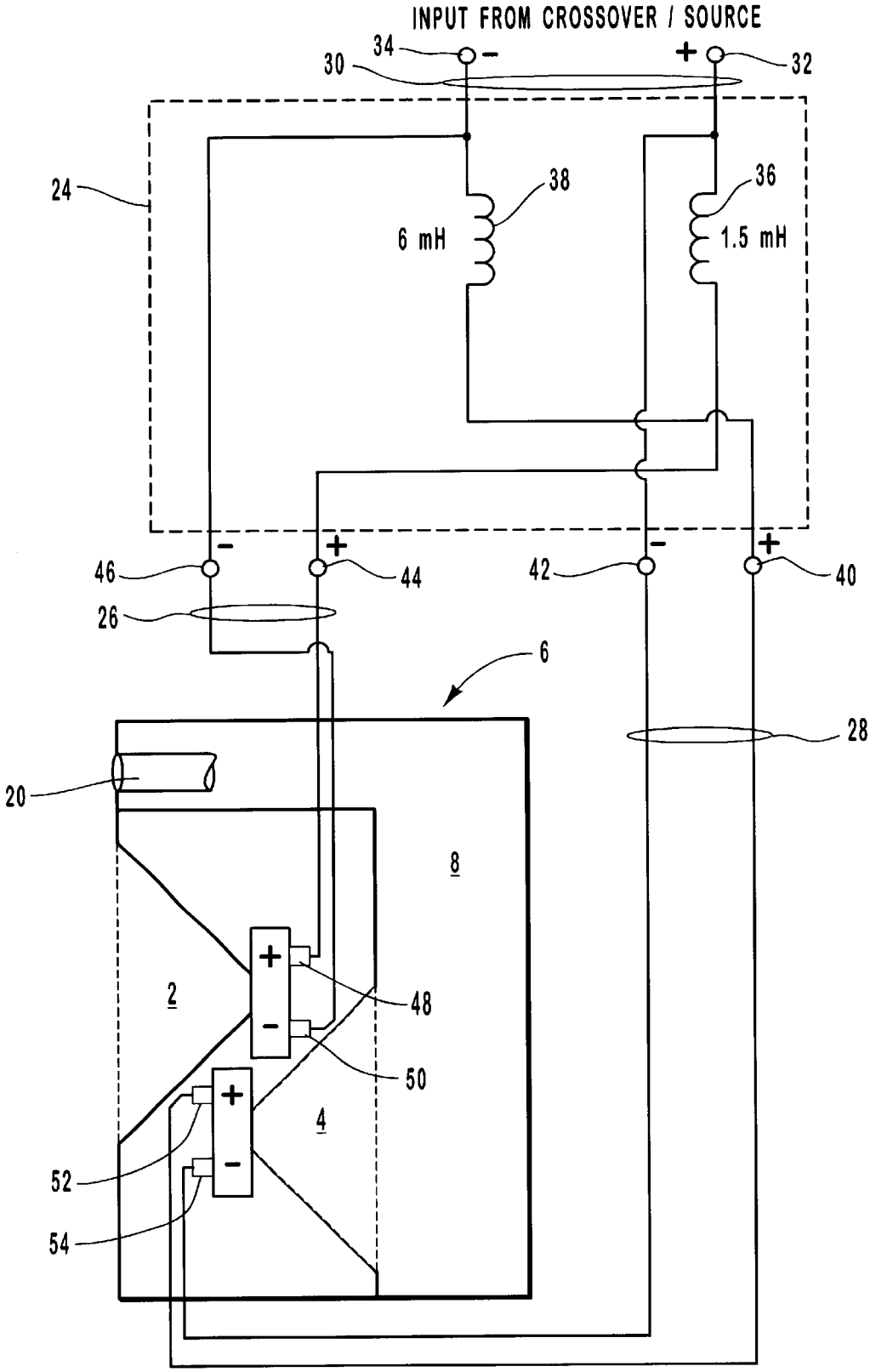
FIG. 3 is schematic diagram of the secondary multiple-driver crossover network of the present invention.

The MD sync circuitry of the present invention consists of a circuit, as shown in FIG. 3, which synchronizes the operation of the one or more pairs of drivers used in a multipolar, isobaric configuration or some other multiple driver configuration. The MD sync circuitry 24 comprises input leads 30 which receive a signal from a source such as the audio output of a sound system. This signal may be run directly into the input leads 30 or routed through a crossover network which filters the incoming signal for the particular drivers being used. When the MD sync circuitry is used with woofers, as in a preferred embodiment, the incoming signal is preferably run through a low pass filter suitable for the drivers used. Regardless of the filter or crossover network used, the incoming signal conductors are connected to input leads 30.

The MD sync circuit of FIG. 3 demonstrates the circuitry used for a preferred embodiment of the present invention which utilizes paired 10" woofers to provide low frequency and midrange sound reproduction. Circuit component values will vary with driver placement and orientation as well as driver size.

Referring to FIG. 3, positive input lead 32 connects directly to negative internal driver output lead 42. Positive input lead 32 also connects to positive external driver output lead 44 through primary inductor 36 with conventional conductors. Negative input lead 34 connects to negative external driver output lead 46 directly. Negative input lead 34 also connects to positive internal driver output lead 40 through synchronization inductor 38. It is believed that primary inductor 36 provides a phase shift in the incoming signal which aligns the low frequency signal of the woofers of this preferred embodiment with the high frequency signal sent to the tweeters. The synchronization inductor 38 introduces a further phase shift to synchronize the backwave of the external driver 2 with the front wave of the internal driver 4.

Negative external driver output lead 46 connects to negative external driver terminal 50. Positive external driver output lead 44 connects to positive external driver terminal 48. Negative internal driver output lead 42 connects to negative internal driver terminal 54. Positive internal driver output lead 40 connects to positive internal driver terminal 52. This connection configuration effectively connects the internal driver 4 in a modified reverse polarity with respect to external driver 4.

The component values used in the MD sync circuitry of the present invention are obtained through an analytical tuning process. To begin the tuning process, primary inductor 36 is selected using known techniques for calculating inductor values for a conventional crossover cutoff frequency between about 2 KHz and 3 KHz. Thiele-Small parameters may be used for these calculations. Most popular calculation techniques will yield an inductor with a value between around 1.5 mH and around 2 mH for this component.

Once the primary inductor has been selected and placed in the circuit, the synchronization inductor 38 is temporarily replaced with a short circuit. A microphone is then placed at the location where the output of the internal driver leaves the enclosure. For a closed-box enclosure, the microphone would typically be placed at the exterior of the box at a point most distal to the internal driver. For a ported box or transmission line enclosure the microphone would be placed at the port or end of transmission line. For a ported box with acoustical chamber 8, such as is shown in FIGS. 1 & 2, the microphone would be placed at the port opening.

An impulse signal is then introduced at the input leads 30 and the resulting output from the drivers is picked up by the microphone and analyzed with appropriate equipment. A fast Fourier transform (FFT) system is preferred for this stage of the tuning method as the resulting signal can be easily singled out and viewed on a computer screen. However, an oscilloscope may also be used for this stage of the process. The resultant response will have two peaks separated by a short time interval. These peaks are believed to correspond to the initial frontwave from the internal driver and the backwave from the external driver.

The object of the tuning process is to introduce a phase shift in the signal to the internal driver which will align the two peaks. This is done through the use of a synchronization inductor 38. The actual synchronization of the peaks is achieved by introducing inductors of various values into the circuit at the position of synchronization inductor 38. Typically, the synchronization inductor 38 will have a value which is higher than the primary inductor 36. The value of the primary inductor 36 is a good starting point for a first trial value for the synchronization inductor 38 especially in face-to-face systems and systems with extremely close driver diaphragms. In systems where the driver diaphragms are not so close, a higher starting value may reduce the time of the tuning process.

Once a synchronization inductor 38 is introduced, an impulse is, again, sent through input leads 30 and the resultant response is measured. The peaks will likely be closer together. This process is repeated while introducing synchronization inductors of different values until the response peaks coincide forming a single response. The result will yield a response impulse of maximum amplitude as the two response peaks coincide to form a single maximized wave.

In an alternative embodiment of the present invention, 12" woofers were placed in a face-to-face configuration in an enclosure similar to that shown in FIG. 2. The inductor values arrived at through the above process were 10.75 mH and 11.5 mH, respectively, for the primary and synchronization inductors respectively.

In another embodiment of the present invention, 6½" drivers were oriented back-to-back in an enclosure similar to that shown in FIG. 1. The inductor values arrived at through the above process were 0.18 mH and 2.0 mH, respectively, for the primary and synchronization inductors.

It should be noted that while inductors are preferred for effectuating a phase shift with the MD sync circuitry, other electrical and electronic components may also be used. Capacitors may be used to effectuate an equivalent phase shift in the input signal. Digital circuitry may also be used to achieve the same result of synchronizing driver waves.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. A loudspeaker apparatus comprising:

an isobaric chamber;

at least one acoustical chamber, disposed adjacent the isobaric chamber and having an output;

at least one group of drivers comprising a first driver and a second driver, the first and second drivers having diaphragms and disposed within the isobaric chamber such that the corresponding diaphragms are linked to one another by pneumatic action, said first driver disposed within the isobaric chamber to directly emit a front wave to the exterior of the loudspeaker apparatus and said second driver disposed within the isobaric chamber to directly emit a front wave to the acoustical chamber; and a synchronization circuit for synchronizing the output of said group of drivers such that the output of the first driver acoustically reinforces the output the second driver in said group.

2. The loudspeaker apparatus of claim 1 wherein the first and second drivers are substantially similar drivers.

3. The loudspeaker apparatus of claim 1 further comprising at least one acoustical chamber for receiving output from at least one of said drivers in said group.

4. The loudspeaker apparatus of claim 1 wherein said synchronization circuit synchronizes an input signal to said drivers so that the output of the first driver resulting from said input signal reinforces the output of the second driver resulting from said input signal.

5. The loudspeaker apparatus of claim 1 wherein said synchronization circuit synchronizes the input signals to the first driver and the second driver such that a back wave of the first driver reinforces the front wave of the second driver.

6. A loudspeaker apparatus comprising:

at least one isobaric chamber;

at least one loudspeaker enclosure;

at least one acoustical chamber, disposed adjacent the isobaric chamber and having an output;

at least one group of drivers, wherein said group comprises pairs of substantially similar drivers, said pairs comprising a first driver and a second driver, said first and second drivers each having a diaphragm, first and second drivers disposed within the isobaric chamber such that the corresponding diaphragms are linked to one another by pneumatic action, said first driver disposed within the isobaric chamber to directly emit a front wave to the exterior of the loudspeaker apparatus and said second driver disposed within the isobaric chamber to directly emit a front wave to the acoustical chamber; and a synchronization circuit for synchronizing the output of said group of drivers such that the output of at least one first driver acoustically reinforces the output of at least one second driver in said group.

7. The loudspeaker apparatus of claim 6 wherein said acoustical chamber resides within said enclosure, and wherein said first drivers of said pairs direct their frontal output out of said enclosure and said second drivers of said pairs direct their frontal output into said acoustical chamber within said enclosure.

8. The loudspeaker apparatus of claim 6 wherein said first drivers are oriented and positioned in relation to said second drivers such that a back wave from said first drivers is directed toward said second drivers and said synchronization circuit causes said second drivers to receive a signal and produce a front wave at the precise moment that said back wave reaches said second drivers thereby forming a reinforced wave.

9. The loudspeaker apparatus of claim 8 wherein said reinforced wave enters said acoustical chamber wherein it is directed to the exterior of said enclosure.

10. A loudspeaker apparatus comprising:

at least one loudspeaker enclosure;

at least one isobaric chamber;

at least one acoustical chamber;

at least one pair of substantially similar drivers, each pair in said at least one pair comprising a first driver and a second driver, each of said first drivers being mounted with a second driver in said at least one isobaric chamber such that a diaphragm of each of said first drivers induces a corresponding movement in a diaphragm of its paired second driver, said first drivers being oriented so that their front wave output is directed out of the enclosure and their back wave output is directed toward said second drivers, said second drivers being oriented so that their front wave output is directed into said acoustical chamber;

a synchronization circuit for synchronizing the output of said pairs of drivers such that the back wave output of said first drivers acoustically reinforces the front wave output of said second drivers thereby forming a reinforced wave.

11. The loudspeaker apparatus of claim 10 wherein said acoustical chamber directs said reinforced wave in the direction of the front wave of said first drivers.

12. A loudspeaker apparatus comprising:

an enclosure;

a first driver disposed within the enclosure;

a second driver, substantially similar to the first driver, disposed within the enclosure and coupled to the first driver in a face-to-face orientation such that only the first and second drivers form an isobaric chamber; and a synchronization circuit for synchronizing the output of the first and second drivers such that the output of the first driver acoustically reinforces the output of the second driver.

13. The loudspeaker apparatus of claim 12 further comprising an acoustical chamber disposed within the enclosure and wherein the second driver is disposed within the acoustical chamber.

14. The loudspeaker apparatus of claim 12 wherein the synchronization circuit synchronizes an input signal to the first and second drivers so that the output of the first driver resulting from the input signal reinforces the output of the second driver resulting from the input signal.

15. The loudspeaker apparatus of claim 12 wherein the synchronization circuit synchronizes the input signals to the first driver and the second driver such that a back wave of the first driver reinforces the front wave of the second driver.

16. The loudspeaker apparatus of claim 12 wherein the first and second drivers each include diaphragms linked to one another by pneumatic action.

* * * * *